US012276063B2

(12) United States Patent
Hansen et al.

(10) Patent No.: US 12,276,063 B2
(45) Date of Patent: Apr. 15, 2025

(54) FOLDING DEVICE FOR FOLDING IRONED LINEN SHEETS, AND A METHOD OF OPERATING THE DEVICE

(71) Applicant: Jensen Denmark A/S, Rønne (DK)

(72) Inventors: Jonas Birk Hansen, Allinge (DK); Jakob Rolsted Jensen, Åkirkeby (DK)

(73) Assignee: JENSEN DENMARK A/S, Rønne (DK)

( * ) Notice: Subject to any disclaimer, the term of this patent is extended or adjusted under 35 U.S.C. 154(b) by 757 days.

(21) Appl. No.: 17/424,864

(22) PCT Filed: Jan. 22, 2020

(86) PCT No.: PCT/EP2020/051517
§ 371 (c)(1),
(2) Date: Jul. 21, 2021

(87) PCT Pub. No.: WO2020/152220
PCT Pub. Date: Jul. 30, 2020

(65) Prior Publication Data

US 2022/0090312 A1 Mar. 24, 2022

(30) Foreign Application Priority Data

Jan. 24, 2019 (DK) ..... PA201970051

(51) Int. Cl.
*D06F 89/00* (2006.01)

(52) U.S. Cl.
CPC ..... *D06F 89/00* (2013.01)

(58) Field of Classification Search
CPC ..... B31B 50/042; B31B 50/102; B31B 50/36; B31B 50/58; B31B 70/58; D06F 89/00;
(Continued)

(56) References Cited

U.S. PATENT DOCUMENTS 3,190,640 A * 6/1965 Sjostrom ..... D06F 89/00 493/422
3,361,424 A * 1/1968 Kamberg ..... D06F 89/00 493/418

(Continued)

FOREIGN PATENT DOCUMENTS

BE 706337 A 3/1968
CN 1533880 A 10/2004

(Continued)

OTHER PUBLICATIONS

First Office Action issued in Chinese Patent Application No. 202080010427.3, dated Mar. 27, 2023, w/ English translation.

(Continued)

*Primary Examiner* — Joshua E Rodden
(74) *Attorney, Agent, or Firm* — McDermott, Will & Emery LLP

(57) ABSTRACT

The invention relates to a folding device for forming folded linen sheets, with a housing having opposite side walls, a rear side and a front side, a first conveyor defining a conveying surface for introducing linen sheets, wherein in operation of the folding device said linen sheets are cross-wise folded defining fold lines parallel and length-wise folded defining fold lines perpendicularly thereto, at least one length-wise folding station for forming length-wise folded linen sheets, wherein in a conveyor loop arranged in said housing below said length-wise folding station(s) and advancing said length-wise folded linen sheets to a housing part, said housing part including a number of cross-wise folding stations for cross-wise folding said length-wise folded linen sheets and including a number of secondary conveyor loops, said secondary conveyor loops carrying and advancing said folded linen sheets.

21 Claims, 9 Drawing Sheets

(58) Field of Classification Search
CPC ..... D06F 89/005; D06F 89/02; D06F 89/023; D06F 89/026
USPC ..... 493/405, 423, 434, 441
See application file for complete search history.

(56) References Cited

U.S. PATENT DOCUMENTS

| | | | | | |
|---|---|---|---|---|---|
| 3,419,261 | A * | 12/1968 | Sjostrom | D06F 89/00 493/23 |
| 3,437,334 | A * | 4/1969 | Maldonado | D06F 89/00 493/19 |
| 4,060,227 | A | 11/1977 | Landgraf et al. | |
| 4,479,640 | A | 10/1984 | Smith | |
| 5,079,867 | A * | 1/1992 | Kober | D06F 69/02 493/441 |
| 5,540,647 | A | 7/1996 | Weiermann et al. | |
| 5,934,523 | A * | 8/1999 | Willett | D06F 89/02 198/604 |
| 8,234,801 | B2 * | 8/2012 | Nielsen | D06F 67/04 38/143 |
| 11,214,916 | B2 * | 1/2022 | Maeshima | B65G 21/14 |
| 11,261,562 | B2 * | 3/2022 | Nitschmann | B65H 37/06 |
| 12,024,814 | B2 * | 7/2024 | Maeshima | D06F 89/023 |
| 2003/0052141 | A1 | 3/2003 | Rauch et al. | |
| 2013/0333255 | A1 | 12/2013 | Parienti | |
| 2015/0191867 | A1 | 7/2015 | Heinz et al. | |
| 2020/0385918 | A1 * | 12/2020 | Naor | D06F 89/00 |
| 2021/0363685 | A1 * | 11/2021 | Chae | D06F 89/02 |
| 2022/0090312 | A1 * | 3/2022 | Hansen | D06F 89/00 |
| 2024/0043237 | A1 * | 2/2024 | Frushtick | B65H 45/16 |

FOREIGN PATENT DOCUMENTS

| | | | |
|---|---|---|---|
| CN | 1878902 | A | 12/2006 |
| CN | 103314153 | A | 9/2013 |
| CN | 105544174 | A | 5/2016 |
| CN | 106436254 | A | 2/2017 |
| CN | 109123865 | A | 1/2019 |
| DE | 4136214 | A1 | 5/1993 |
| EP | 0612879 | A1 | 8/1994 |
| EP | 1295982 | A1 | 3/2003 |
| EP | 1464583 | A | 10/2004 |
| EP | 2392727 | A1 | 12/2011 |
| EP | 2963174 | A1 | 1/2016 |
| GB | 521310 | | 5/1940 |
| GB | 1058846 | A | 2/1967 |
| GB | 1158655 | A | 7/1969 |
| JP | S57105201 | A | 6/1982 |
| JP | S60169164 | A | 9/1985 |
| JP | H06-198100 | A | 7/1994 |
| JP | H11165000 | A | 6/1999 |
| WO | 2016/009632 | A1 | 1/2016 |
| WO | 2018/078764 | A1 | 5/2018 |

OTHER PUBLICATIONS

Chinese Office Action issued in corresponding Chinese Application No. 2020800104273, dated Dec. 21, 2023, with English translation.
Search Report issued in Danish Patent Application No. PA 2019 70050, dated Aug. 2, 2019.
Search Report issued in Danish Patent Application No. PA 2019 70051, dated Aug. 2, 2019.
Search Report issued in Danish Patent Application No. PA 2019 70052, dated Aug. 5, 2019.
International Search Report & Written Opinion issued in International Patent Application No. PCT/EP2020/051512, dated Apr. 28, 2020.
International Preliminary Report on Patentability issued in International Patent Application No. PCT/EP2020/051512, dated Jul. 27, 2021.
International Search Report & Written Opinion issued in International Patent Application No. PCT/EP2020/051517, dated Apr. 17, 2020.
International Preliminary Report on Patentability issued in International Patent Application No. PCT/EP2020/051517, dated Jul. 27, 2021.
VS1R-N4 Catalog Brochure located at URL: https://www.totofolder.jp/en/products/sheets-folder/catalog/VS1R-N4.pdf. w/Partial English Translation.
Notification of Reasons for Refusal issued in Japanese Patent Application No. 2021-542119, dated Oct. 3, 2023, w/ English translation.

* cited by examiner

FOLDING DEVICE FOR FOLDING IRONED LINEN SHEETS, AND A METHOD OF OPERATING THE DEVICE

CROSS-REFERENCE OF RELATED APPLICATIONS

This application is the U.S. National Phase under 35 U.S.C. § 371 of International Patent Application No. PCT/EP2020/051517, filed on Jan. 22, 2020, which in turn claims priority to Denmark Patent Application No. PA201970051, filed on Jan. 24, 2019, the entire disclosures of which Applications are incorporated by reference herein for all purposes.

The present invention relates to equipment for use in industrial laundries, in particular to an improved industrial folding device for length-wise and cross-wise folding of cloth pieces.

An example of a prior art industrial folding device is disclosed in EP-A-2014798031. Where such industrial folding devices are to perform also a cross-wise folding in addition to a length-wise folding of the laundered cloth pieces, possibly with a subsequent stacking of the folded cloth pieces the prior art industrial folding devices generally take up a large floor area of the industrial laundry facility.

The object of the present invention is to solve problems associated with prior art folding devices as defined in the preamble of claim 1, by allowing for length-wise and cross-wise folding, as well as any stacking operations, to be performed with a relatively low footprint of the folding device.

SUMMARY

In view of this object, a folding device as further defined in the characterising clause of claim 1 is provided.

In one embodiment, in a housing part for cross-folding there is a first frame carrying a first secondary linen sheet conveyor loop and/or a second frame carrying a second secondary linen sheet loop are movably, such as pivotally, supported, the folding device being configured for releasably maintaining the first and second frame in a position close to one another and for releasably maintaining, such as by a releasable lock, such as a latch, the first and second frames in positions distant from each other. This allows an operator easy access for removing linen sheets that for some reason have become stock inside the housing part.

In another embodiment, the folding device may allow for simultaneous processing of several cloth pieces introduced along-side each other with their leading edges being offset or not relative to one another, by providing several length-wise folding station across a width of the folding device and being controlled to act in sync or out of sync relative to one another. A claim is directed towards a method of using the device of that embodiment, comprising activating the length-wise folding stations in sync or out of sync relative to one another and/or, for each folding station, activating movement of a folding blade and/or air blast nozzles to provide an air blast for length-wise folding a linen sheet.

In yet another embodiment the folder device has one or more folded linen sheet stacker modules for stacking the folded linen sheets being positioned below folding stations performing a length-wise folding, and a stacker conveyor for advancing the folded linen sheets to the stacker modules, the aforementioned housing part of the folding device being located on a floor area next to that where the length-wise folding takes place.

As a further result of the invention, in one embodiment the folding device may allow for a person to perform maintenance while standing upright or substantially upright in a convenient working position.

As the skilled person will understand, the folding device of the present invention, to be discussed in the following, may provide overall benefits to the operation of any industrial laundry installation, irrespectively of the type of processing equipment placed upstream of the folder; this will apply equally where the present folding device replaces a worn out folder in an existing installation, and where the present folding device is supplied as a part of a new industrial laundry installation. Certain embodiments of the present folder may provide particular benefits where operated in connection with an ironer with rollers followed by a burner positioned immediately upstream of the present folder, in addition to other benefits relating to the ease of removing from the present folder cloth pieces that have caused an interruption of the folding process and, hence, delays in the processing of cloth pieces in the entire laundry installation.

For simplicity, in the following laundered cloth pieces/flat textile material pieces, such as table covers, bedcovers, pillowcases and towels, will be referred to generally as linen sheets. The present invention is useful for folding such linen sheets as desired, irrespectively of their shape, eg. irrespectively of the linen sheets being round, rectangular or square in shape. Several folds may be formed parallel with and/or perpendicularly to an edge of each rectangular or square linen sheet.

Additional advantages and problem solutions defined inter alia in the dependent claims will be clear from the below description.

DETAILED DESCRIPTION

The invention will now be explained in more detail by reference to the drawings that show presently preferred embodiments thereof.

Figure 1A:
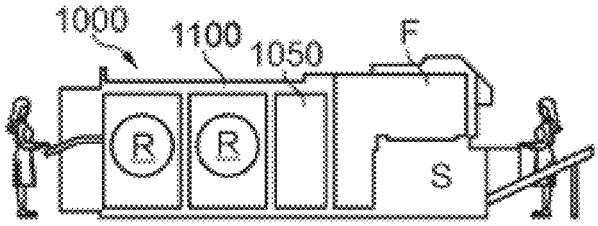
Fig. 1a PRIOR ART
FIGS. 1*a* and 1*b* illustrate schematically a prior art industrial laundry installation, seen from the side and top, respectively.
Figure 1B:
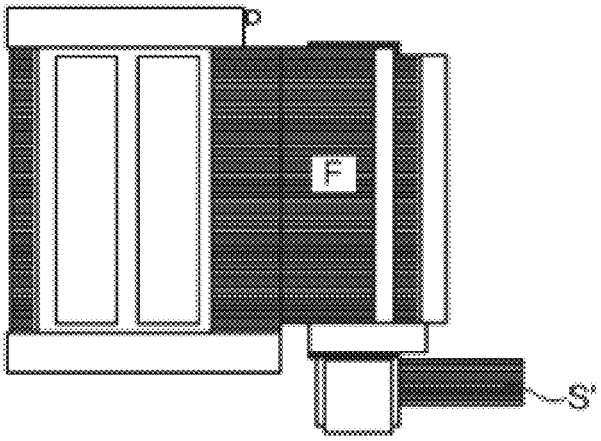
Fig. 1b PRIOR ART

FIGS. 1*a* and 1*b* illustrate schematically a prior art industrial laundry installation 1000 for ironing and subsequent folding of flat cloth pieces, such as bedcovers, pillowcases and towels. The shown installation 1000 comprises an ironer 1100 of the type known as the "Jenroll EX™", which ironer 1100 includes a sequence of heated rollers R followed by a burner 1050 supplying a heating medium to the rollers R, followed by a folding device F, in the following referred to generally as a folder, for folding ironed cloth pieces as required by an end user. The shown folder F is of the type known as the "Jenfold Classic SW™", cooperating with a folded linen stacker unit S known as the "Jenstack Max SW™" positioned alongside the folder F. The stacker unit S forms stacks of folded cloth pieces that may be discharged at intervals by a discharge conveyor S'.

In operation, laundered spread out cloth pieces L are introduced manually and individually into the shown ironer 1100 at the front end thereof, and advanced from left to right in FIG. 1*a*; automated introduction by an automated feeder having a cloth piece spreader, such as the feeder shown in WO2017153511, being placed immediately in front of the ironer 1100, i.e. to the left of the ironer 1100 shown in FIG. 1*a*, may alternatively be carried out. Depending on the ironer 1100 width, two or more cloth pieces may be ironed simultaneously, being passed through the ironer 1100, alongside each other.

Figure 1C:
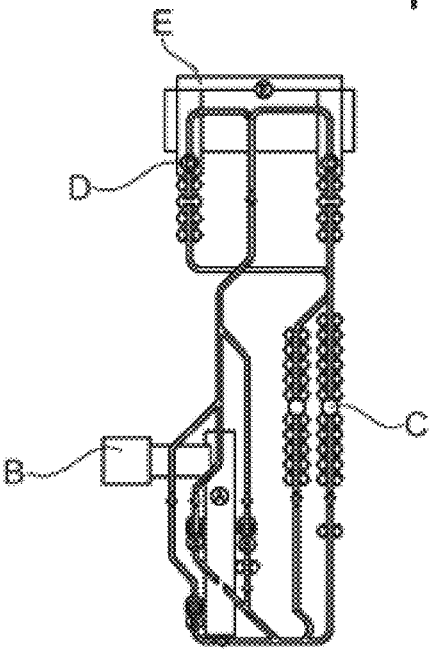
FIGS. 1*c* and 1*d* show schematically additional cloth piece processing equipment arranged upstream of the installation of FIGS. 1*a* and *b;*
Figure 1D:
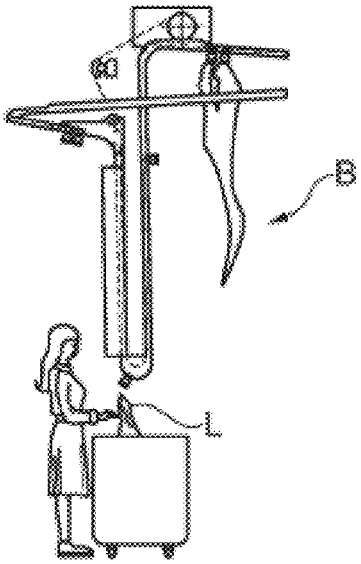

FIGS. 1*c* and 1*d* schematically show additional cloth piece processing equipment that may be arranged upstream of an installation 1000 as shown generally in FIG. 1*a*, and including the aforementioned automated feeder, referred to in FIG. 1*c* by letter E. Overhead conveyor rails convey the cloth pieces L in suspended form to the automated feeder E from a position A where the laundered cloth pieces L received from washing machines (not shown) are inserted into clamps that move along the overhead rails from a loading station B, via buffer and deloading stations C, D. The step of inserting the cloth pieces L into the clamps may be carried out using the device illustrated in PCT/EP2018/077293.

Figure 2A:
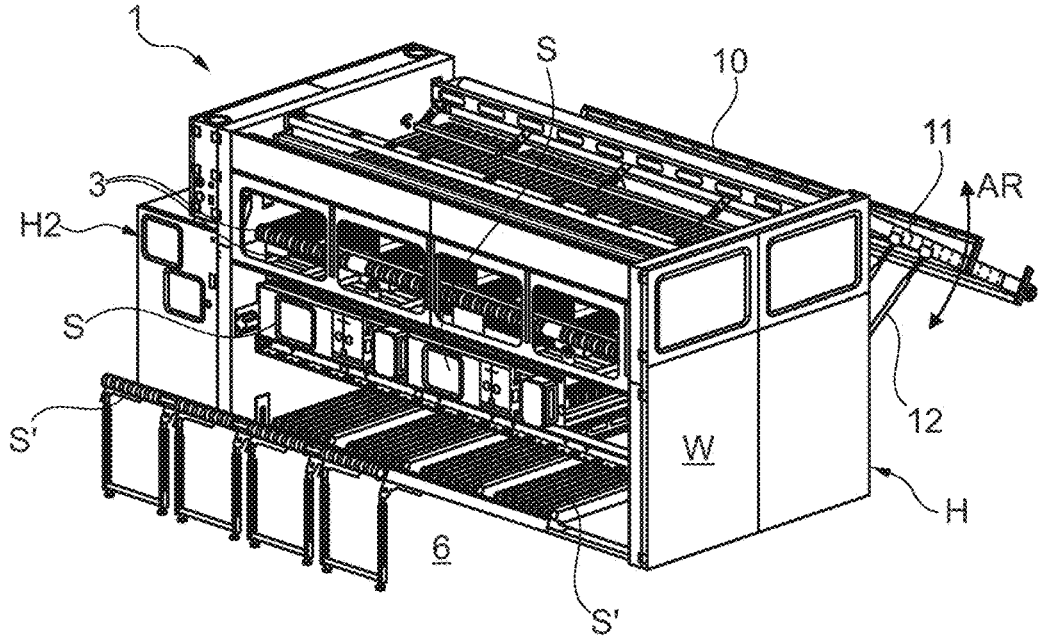
FIGS. 2*a* and 2*b* are front and rear perspective views, respectively, of the folder of the present invention, FIG. 2*c* showing schematically the folder arranged downstream of an ironer.
Figure 2B:
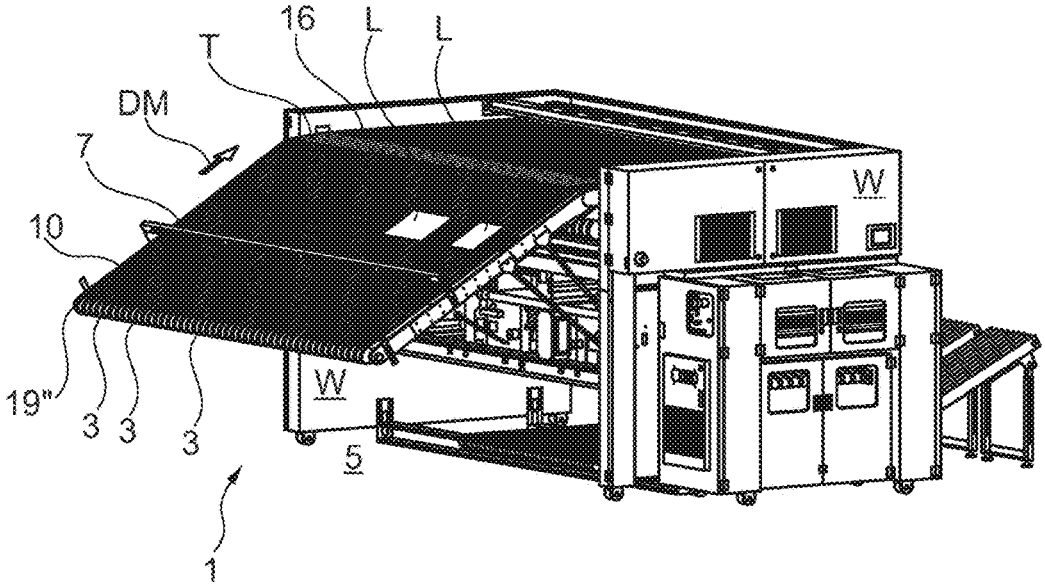

FIGS. 2*a* and 2*b* are front and rear perspective views, respectively, of the folder of the present invention, designated reference numeral 1. The folder 1 includes a housing H having a rear side 5 and a front side 6 and enclosing a frame structure carrying a variety of primary conveyor loops, each conveyor loop comprising an elongated belt, wherein the belt of some or all of the conveyor loops may be defined by a plurality of individual, adjacent and parallel spaced apart ribbons 3, with the ends of the ribbons 3 being joined to form individual closed loops, running at the same speed.

Figure 2C:
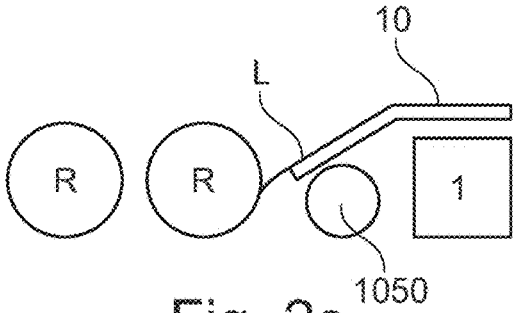
FIGS. 2*d* and 2*e* show different modes of operation of the folder of FIG. 2*a*.

In operation, linen sheets L are advanced from an ironer and normally introduced automatically, one after another or alongside each other as shown in FIG. 2*b*, into the folder 1 at the rear side 5 thereof, lying flatly on the upper run of a first conveyor 10 extending from the output side of the ironer above the ironer boiler 1050, see FIG. 2*c*, to a top portion T of the folder 1. The linen sheets L are normally introduced with two opposite edges thereof extending generally parallel with the shown direction of movement DM of the conveying surface of the first conveyor 10 so that in operation of the folder 1 the linen sheets L are eventually folded along fold lines parallel with and/or perpendicularly to the aforementioned edges. A fold line parallel with the direction of movement DM of the conveying surface of the first conveyor 10 will in the following be referred to as a cross-wise fold while a fold line perpendicularly thereto will be referred to as a length-wise fold.

The housing H includes opposite side walls W defining parts of opposite ends of the folder 1, and by proper operation of the folder 1 and/or dimensioning of the distance between the opposite walls W, several linen sheets L may be processed simultaneously by the folder 1, being passed into the folder 1 lying alongside each other on the conveying surface of the first conveyor 10, as shown in FIG. 2*b*. Such a folder 1 of the present invention may selectively, by way of example, be operated in what is referred to below as a two-lane mode or a four-lane mode. A folder 1 of the present invention where the aforementioned distance is 4 m, with different operations thereof being exemplified schematically in FIG. 2*d*, may in four-lane mode allow for simultaneous processing of four rectangular linen sheets L, each having a width of about 1 m, introduced alongside each other with their longer edges being parallel with the direction of movement of the conveying surface of the first conveyor 10. Other modes of operation are illustrated in FIGS. 2*d* and 2*e*, such as a folder 1 operable in two-lane mode (lane1+lane2 in unity/in sync and lane3+lane4 in unity/in sync) or alternatively in a three-lane mode (lane1+lane2 in unity/in sync and lane3+lane4 in unity/in sync and lane5+lane6 in unity/in sync).

Figure 2D:
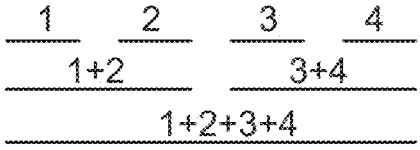
Figure 2E:
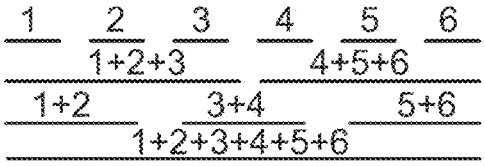

Irrespectively of the folder 1 being set for single-lane operation (such as for operation in unity/in sync of lane1+lane2+lane3+lane4 in FIG. 2*d*) or multi-lane operation typically the conveyor loops in a first portion of the folder 1 will be defined each by a single belt, optionally by a multiplicity of the aforementioned parallel ribbons 3, running in the shown embodiment all continuously at a constant and same speed.

In the following, the direction from the rear side 5 to the front side 6 will be referred to as the first machine direction, coinciding with the direction of linen sheet L movement DM indicated in FIG. 2*b*, while a direction perpendicularly thereto, towards one or the other one of the housing H walls W will be referred to as the second machine direction of the folder 1.

Preferably, as shown, the first conveyor 10 is a structural part of the folder 1, with a first conveyor 10 frame 11 being adjustably connected to the housing H at the top portion T thereof, preferably via a hinge allowing some angular adjustment (as shown by the arrows AR in FIG. 2*a*) of the first conveyor 10 with respect to the vertical, such as by means of actuators 12, to allow the first conveyor 10 to reach the level of the output of the ironer 1100 shown schematically in FIG. 1*a*.

The general folder 1 height and the first conveyor frame 11 are preferably configured and arranged, respectively, so as to leave a space below the first conveyor frame 11 sufficient to allow a person to stand upright next to the rear side 5, eg. to leave a height P (see FIG. 3*a*) between the floor FL of the building in which the folder 1 is placed and the first conveyor frame 11 of at least 1.6 metres, preferably at least 1.7 metres, preferably at least 1.8 metres or even more. This allows a standing up human operator (not shown) to comfortably access the inside of the housing H from the rear side 5 for maintenance and/or for removing linen sheets L that have become stock inside the folder 1.

The aforementioned general height P of the folder 1 conveniently allows for a plurality of folded linen piece stacker modules S to be positioned next to each other in the direction between the walls W and generally within the folder 1 housing H at the front side 6, thereby allowing a sorting of the folded linen sheets L into several adjacent stacks without significantly increasing the footprint of the folder 1, as would be the case if the folder F of FIG. 1*b* had several such stacker units S placed alongside thereof. The stacker modules S are optionally arranged and configured to discharge, upon request, stacks of folded linen sheets L stored within each stacker module S, by dropping them onto a respective, associated discharge conveyor S' located directly below the folder 1, at the front side 6.

Figure 3A:
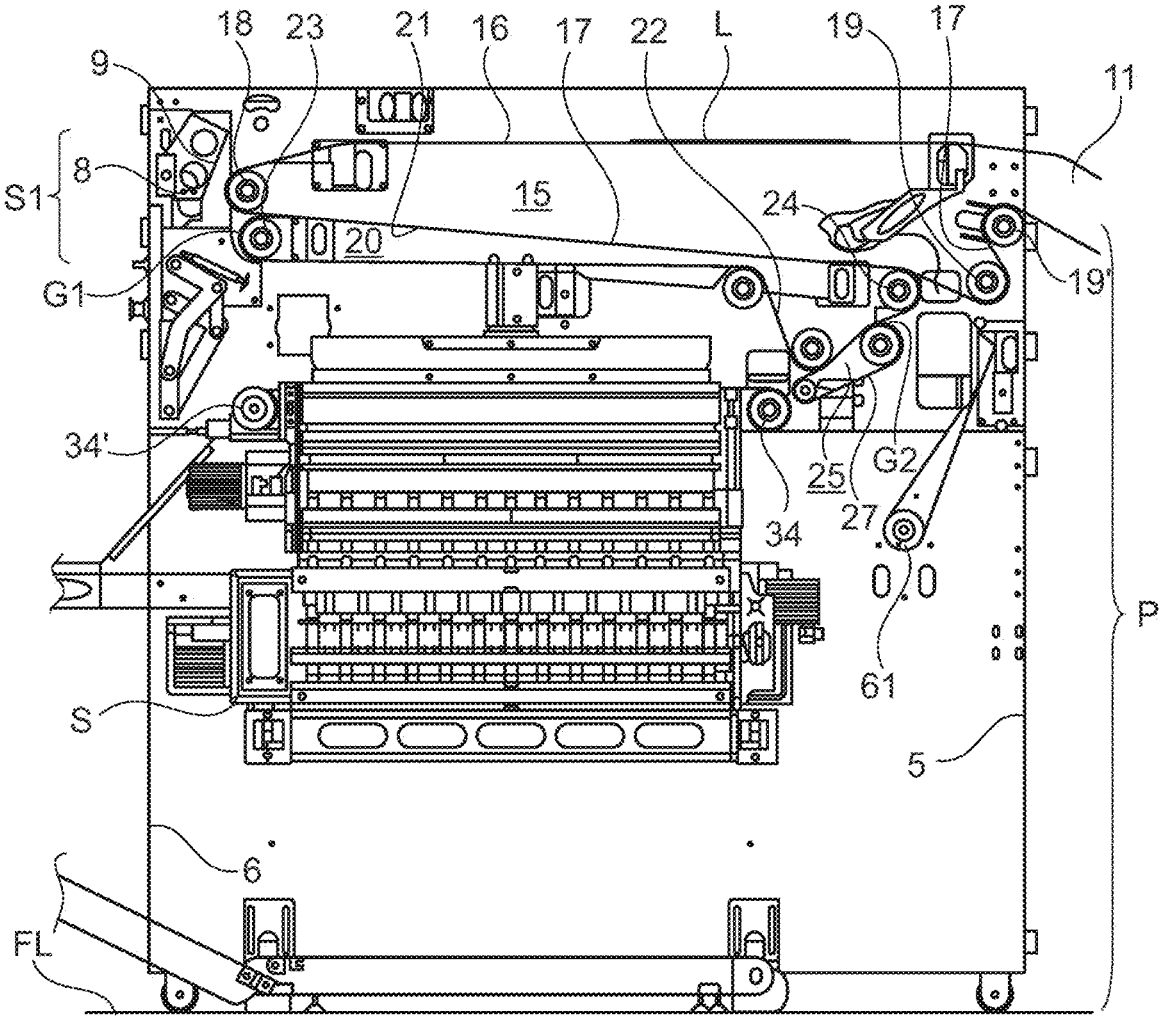
FIGS. 3*a* and 3*b* are cross-sectional side and perspective views showing a first part of the folder of FIG. 2*a;*

As seen best in FIG. 3*a*, a first conveyor loop 15 of a sequence of primary conveyor loops extends above the plurality of stacker modules S from outside the housing H, along the first conveyor frame 11 and to the front side 5 of the folder 1. Alternatively, the first conveyor 10 carried by the first conveyor frame 11 may include a conveyor loop delivering the linen sheets L to a first primary conveyor loop 15 extending in this case above the stacker modules S and inside the housing H only, allowing for the first conveyor 10 to be removed from the folder 1, in which case the separate first conveyor frame 11 may conveniently be provided with supporting legs, optionally with wheels, resting on the floor FL.

A second conveyor loop 20 and a third conveyor loop 25 of the primary conveyor loops likewise extend inside the housing H at levels between the first conveyor loop 15 and the stacker modules S, in the direction between the rear side 5 and the front side 6.

Figure 3B:
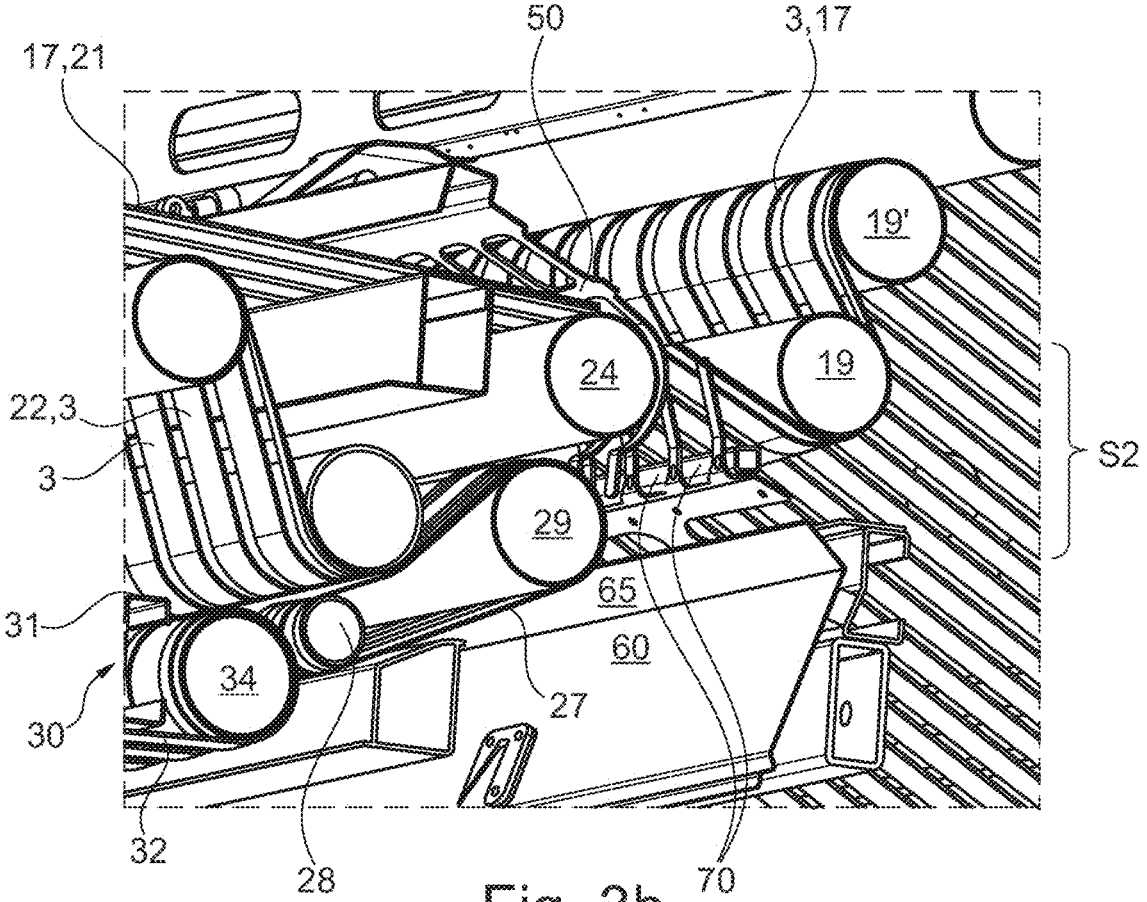

As shown in FIGS. 3*a* and 3*b*, each first, second and third conveyor loop 15, 20, 25 includes an upper and a lower run and is guided and driven by a number of rollers. The upper run 16 of the first conveyor loop 15 carries and advances the linen sheets L in the first machine direction towards the front side 6 of the folder 1, to a first conveyor loop 15 front roller 18. A lower run of the first conveyor loop 15 designated reference numeral 17 extends back to first conveyor loop 15 rear rollers 19, 19' closer to the rear side 5.

The upper run 21 of the second conveyor loop 20 is configured to then receive, carry and convey the linen sheets L in the direction opposite the first machine direction towards the rear side 5 of the folder 1, to a second conveyor loop 20 rear roller 24. A lower run and front roller of the second conveyor loop 20 are designated reference numerals 22 and 23, respectively. For advancing linen sheets L in the directions mentioned above, the two front rollers 18, 23 rotate in opposite directions, the upper roller 18 rotating anticlockwise while the lower roller 23 rotates clockwise.

The two aforementioned front rollers 18, 23 are arranged close to each other, to define a narrow gap G1 between the lower run 17 of the first conveyor loop 15 and the upper run 21 of the second conveyor loop 20. An elongated bar 8 comprising a plurality of high pressure air outlets is located to define a number of individually controllable first folding stations S1 along the length between the opposite walls W of the folder 1, with air discharge nozzles oriented towards the gap G1. A curved pivotable linen sheet L first guide member 9 shaped as the guide member referenced by numeral 50 in FIG. 4*b* and driven by a guide actuator may be provided. Generally, the guide members discussed herein similar to that shown schematically by reference numeral 50 comprise a series of adjacent prongs that extend into the space between the adjacent ribbons 3 that define the conveyor loops belts.

The number of first folding stations S1 provided along the length between the two opposite walls W corresponds to the number of lanes serviced by the folder 1 at a given time, with one first folding station S1 serving each lane. Where either i) a linen sheet L having an exceptionally large size is introduced into the folder 1 such that it spans across more than one lane (see FIG. 2*e*, eg. a mode where lane1+lane2+lane3 operate in sync) or ii) a linen sheet L of normal size is introduced such that it lies across more than one lane, then two or more of the first folding stations S1 are controlled for synchronised operation. For the mode lane1+lane2+lane3 in FIG. 2*e* this means that the air discharge nozzles of three neighbouring first folding stations S1 are activated simultaneously, i.e. there is a synchronised operation of the neighbouring first folding stations S1.

Normally, in a single-lane mode where a linen sheet L advanced along one lane, the linen sheet L will not arrive at the corresponding first folding station S1 at the same time as another linen sheet advanced alongside in another lane such that there will be no such synchronised operation. Activation of the respective first folding stations S1 for performing a folding will be by controllers receiving for each lane positional and dimensional sensor data for the linen sheets L to be processed, from an array of sensors 7 that may be located at the rear side 5 of the folder 1, such as in the manner shown in FIG. 2*b*.

For the first folding station S1, when a linen sheet L is advanced by the upper run 16 its leading edge, normally being a shorter edge thereof, will eventually leave the upper run 16 at the first conveyor loop 15 front roller 18, with a gradually increasing front part of the linen sheet L hanging suspended at the front side 5 of the folder 1 within the housing H. This will be the case where the first guide member 9 is in an inactive, retracted position similar to that of a second guide member 50 shown in FIG. 4*b*, when folding is to be performed at the first folding station S1.

Figure 4A:
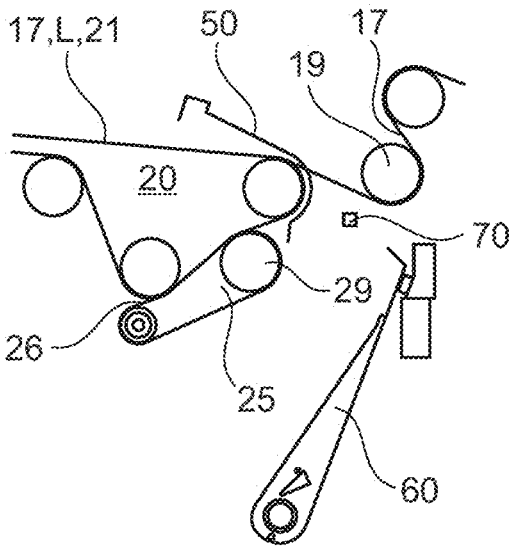
FIGS. 4*a*-4*c* show various configurations of movable parts of length-wise folding stations.

At a given time, normally where slightly more than half of the length of the linen sheet L hangs suspended, an air blast is set to leave the nozzles of bar 8 of the folding station S1, forcing the part of the linen sheet L located immediately between the bar 8 and the gap G1 into the gap G1, thereby generating a first length-wise fold as the linen sheet L is drawn into the gap G1 through contact with the respective moving loops 15, 20. In this manner is the linen sheet L doubled in the way that the trailing edge thereof now overlies the leading edge thereof, the doubled linen sheet L being now carried by the upper run 21 of the second conveyor loop 20.

Where the first guide member 9 has alternatively been moved to an advanced position (similar to the position shown in FIG. 4*a* to be discussed below) the linen sheet L leading edge is simply directed onwards into the gap G1 between the front rollers 18, 23, the linen sheet L being advanced with no folding taking place.

During this entire procedure the first and second conveyors loops 15, 20 normally move continuously, at the same constant speed. It is preferred that the lower run 17 contacts the linen sheet L now carried by the upper run 21 for at least some part of the onward movement of the linen sheet L.

Depending on the controllable actions taken at the first folding station S1 the linen sheet L is advanced with or without the leading edge being defined by a first linen fold, towards the second loop 20 rear roller 24 shown in the enlarged view of FIG. 3*b*.

The aforementioned third conveyor loop 25 has an upper run 26 configured for carrying the linen sheet L onwards in the first machine direction towards the front side 6 of the folder 1, and extends around a third conveyor loop 25 front roller 28 and a third conveyor loop 25 rear roller 29, with a lower run thereof designated numeral 27. The two rear rollers 24 and 29 are arranged to define a number of individually controllable second folding stations S2 between the opposite walls W, together with an optional respective curved pivotable linen sheet L second guide member 50 driven each by a guide member 50 actuator, a respective pivotable elongated blade 60, respective blade actuators 61, respective blade abutments 62 and a respective bar 70 comprising a plurality of optional high pressure air outlets.

The rear rollers 24, 29 are arranged to define a converging gap G2 between the lower run 22 of the second conveyor loop 20 and the upper run 26 of the third conveyor loop 25, the aforementioned air outlets being configured to provide a blast of air directed towards this gap G2. The resilience of the belt/ribbons 3 forming the second and third conveyor loops 20, 25 allows for folded linen sheets L of different thickness to be received between the lower run 22 and the upper run 26 and to be conveyed onwards, sandwiched between the lower run 21 and the upper run 26. This follows from one or both of the lower/uppers runs 22, 26 yielding upwards/downwards and acting somehow as a spring where the linen sheet L is introduced into the gap G2.

It will be understood that for each first folding station S1 there is a corresponding second folding station S2, the second folding stations S2 being also placed next to each other between the opposite walls W of the folder 1. As is the case for the first folding stations S1 two or more of such second folding stations S2 may be controlled for synchronised operation where a linen sheet L spans across several lanes, such as in lane1+lane2+lane3 mode as shown in FIG. 1*e*. Linen sheets L will normally not arrive at the corresponding second folding station(s) S2 at the same time as another linen sheet advanced alongside; moreover, folding operations performed on one linen sheet L may be different from those performed on another linen sheet L advanced along-side, in which case also no synchronised operation of the second folding stations S2 will occur.

Figure 4B:
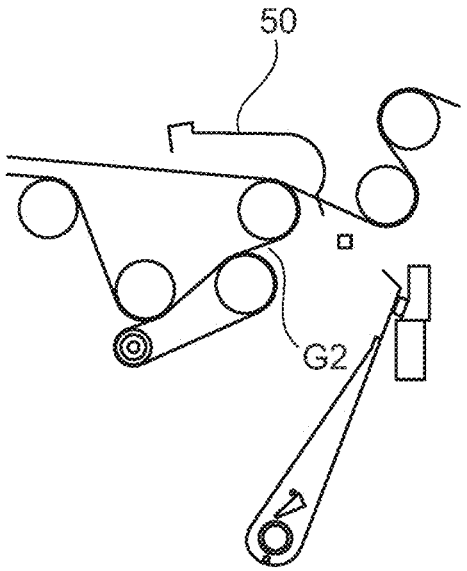

As a linen sheet L leading edge enters a second folding station S2 resting on the second conveyor loop 20 upper run 21, a gradually increasing front part of the linen sheet L will in a first, retracted position of the second guide member 50 shown in FIG. 4*b* hang suspended at the rear side 6 of the folder 1 inside the housing H in front of the gap G2. In an alternative, advanced second position of the second guide member 50 shown in FIG. 4*a* the linen sheet L is simply directed onwards directly into the gap G2 between the rear rollers 24, 29 without any folding, the linen sheet L having been folded or not at the corresponding first folding station S1.

In the retracted first position of the optional second guide member 50 of the second folding station S2, folding of the linen sheet L may be achieved in two ways: by means of the movable blade 60 or by means of an air blast leaving the air outlets of optional bar 70. Using an air blast may by way of example be preferred where the linen sheet L has not previously been folded at the corresponding first folding station S1, in which case folding of the linen sheet L does not require any significant force to drive the linen sheet L into the gap G2. Where, alternatively, the linen sheet L was folded at station S1 the thickness of the folded linen sheet L may provide such a resistance to folding that a stronger force as provided by the moving blade 60 is required to drive the linen sheet L into the gap G2, so as to define a new, further fold line which then forms the leading edge of the folded linen sheet L.

Figure 4C:
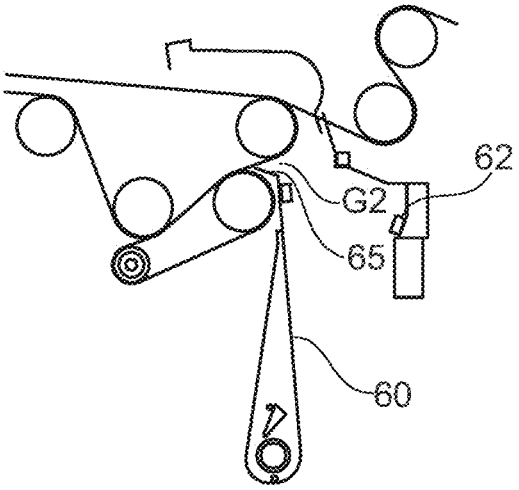

The folding at stations S2 may, depending on the selected movement of the blade 60 be so as to form one or two length-wise folds by the blade 60. For making one fold only at a folding station S2, the blade 60 is turned once, from a retracted position resting against an abutment 62 to an advanced position shown in FIG. 4*c* where a nose portion 65 thereof extends into the gap G2, the blade 60 resting against another abutment. This turning movement is performed when a front portion of the moving linen sheet L hangs suspended from the rear roller 24, in front of the gap G2 and to the left of the blade 60 in its retracted position shown in FIG. 4*b*. Alternatively, for making two folds two turning operations in opposite directions of the blade 60 is carried out, in principle in the manner disclosed in FIGS. 4 of EP-A-2014798031, with the blade 60 initially being in the aforementioned advanced position shown in FIG. 4*c* and the linen sheet L suspended to the right of the blade 60, then moved to the position shown in FIG. 4*b* for folding the linen sheet L, and then finally to the position shown in FIG. 4*c*, thereby driving the linen sheet L into the gap G2 for yet another folding at folding station G2.

While one could in principle use only the blade 60 for performing all length-wise folding operations at folding station S2 it is convenient to allow for the provision of the bar 70 generating for the corresponding second folding station S2 an air blast whenever desired, for the above-mentioned reason, and for instances where the air blast may in fact assist the folding operation carried out by the blade 60.

The aforementioned first, second and third primary conveyor loops 15, 20, 25 define a first part of the folder 1 wherein the belts of the primary conveyor loops 15, 20, 25 normally all advance linen sheets L at the same speed such that a linen sheet L will be advanced at the same speed irrespectively of the lane along which it runs.

Figure 5A:
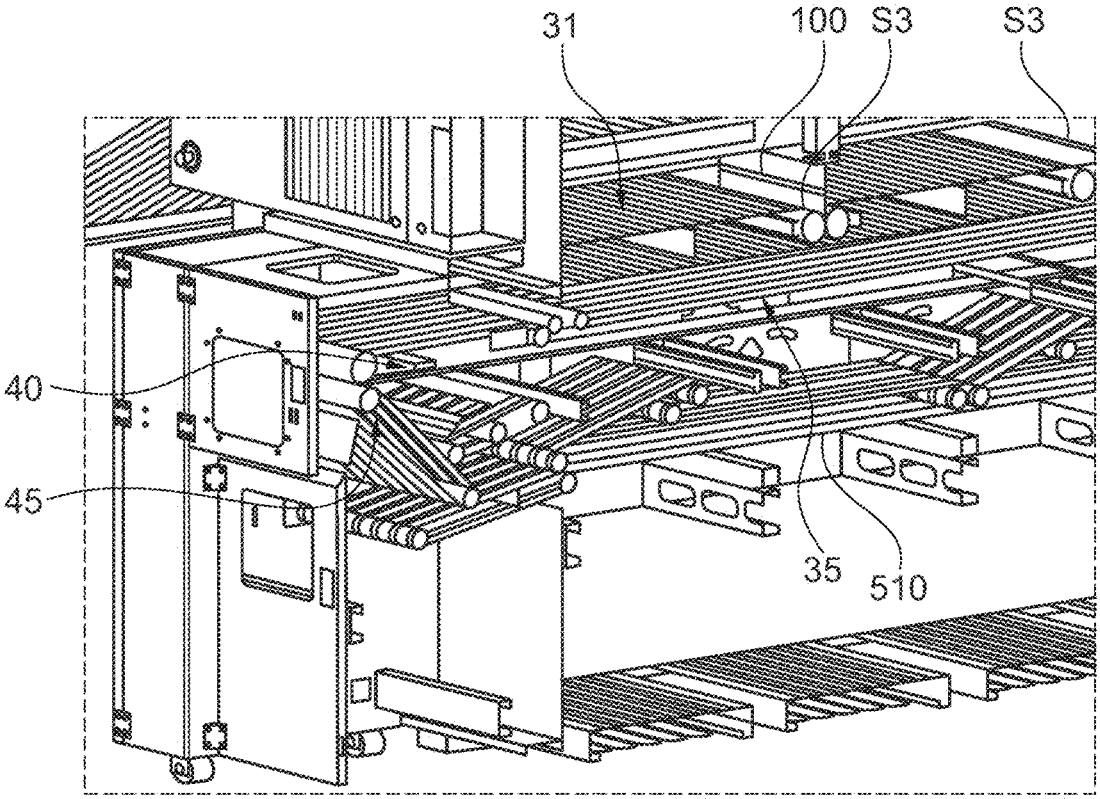
FIGS. 5*a*-5*c* show perspective and front views of cross-wise folding station, seen towards the front of the folder of FIG. 2*a;*
Figure 5B:
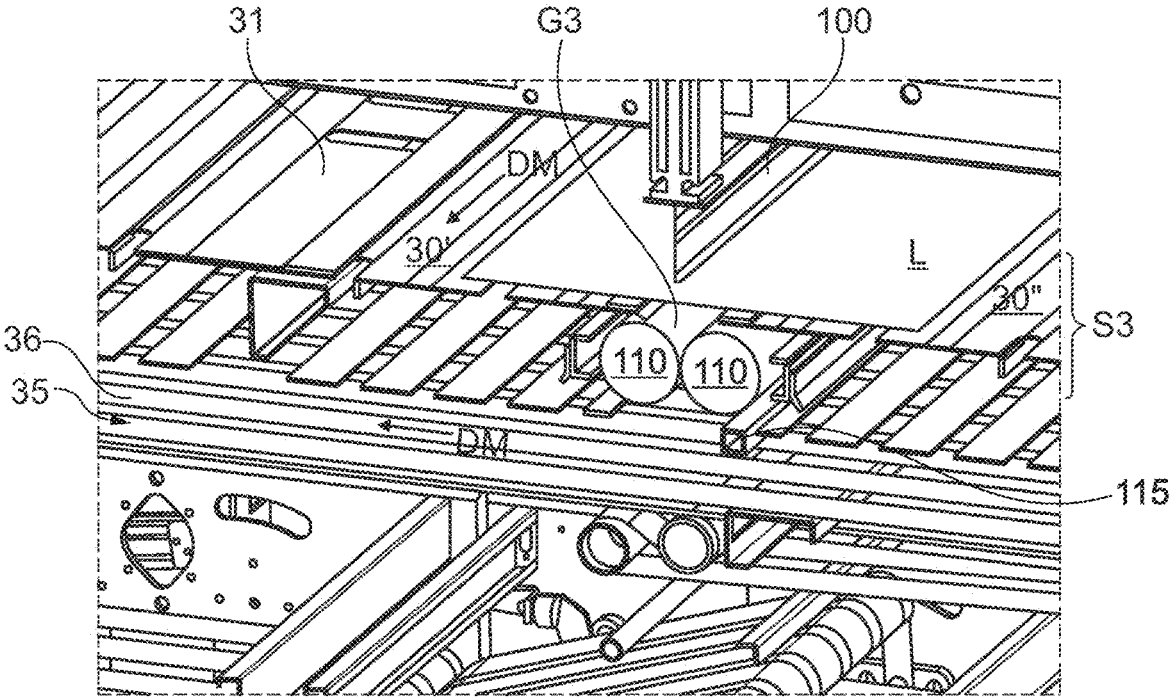

A second, downstream part of the folder 1 to be discussed now and seen best in FIGS. 5*a* and 5*b* includes one or more, normally individually controllable and parallel fourth conveyor loops 30, the number of which normally corresponding to the number of individual folding stations S2 between the walls W and, hence, to the number of lanes that the folder 1 may service, i.e. to the lane-mode in which it may operate. The third conveyor loop 25 delivers linen sheets L to a corresponding one of one or more fourth conveyor loops 30 that advance the linen sheets L further in the first machine direction towards the front side 6. The fourth conveyor loops 30 each have an upper run 31 carrying the linen sheets L and a lower run 32 and are guided by a respective front roller 34' and rear roller 34, as shown in FIGS. 3*a* and 3*b*.

Figure 5C:
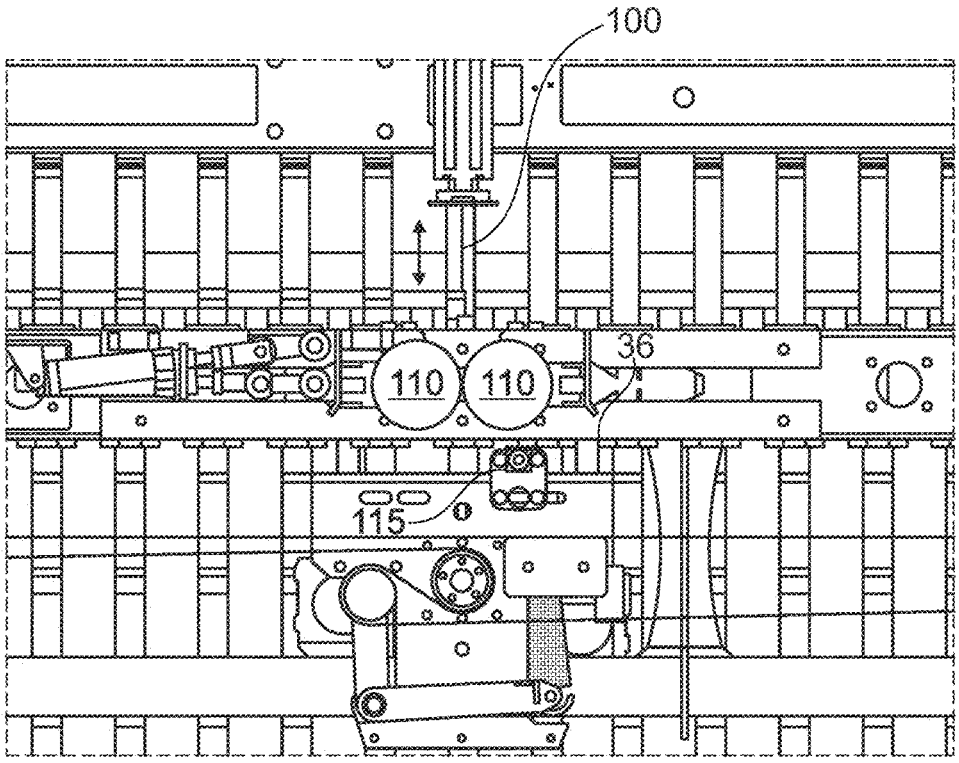

As shown in FIGS. 5*a-c*, a number of primary cross-wise folding stations S3, each receiving linen sheets L from a corresponding upstream second folding station S2, is each defined by a respective one of the fourth conveyor loops 30 as well as by air nozzles 115 and a cross-wise folding blade 100 movable up and down into a gap G3 between two neighbouring belts or ribbons 30', 30" that define in combination a respective one of the fourth conveyor loops 30. The primary cross-wise folding stations S3 are distinguished from the first and second folding stations S1, S2 in carrying out a cross-wise folding to provide a cross-wise fold, as explained below. Each of the fourth conveyor loops 30 is controllable to temporarily stop moving as cross-wise folding is performed by the corresponding primary cross-wise folding station S3 blade 100. This stands in contrast to the movement of the first, second and third conveyor loops that generally run continuously in the first part of the folder 1.

Where the folder 1 is operated in the way that a linen sheet L is introduced into the folder 1 such that it lies across more than one lane, such as centrally on the first conveyor 10, see eg. the lane3+lane4 mode shown in FIG. 2*e*, then this will be detected by the sensors 7 and two or more neighbouring fourth conveyor loops 30 will be operated to simultaneously run and temporarily stop while a selected one, normally a centrally located one, of the plurality of cross-wise folding station S3 blades 100 is operated to carry out the cross-wise folding.

Located inside each of the fourth conveyor loops 30 along the gap G3 are a pair of opposite rollers 110 driven by integrated drum motors and rotating in opposite directions about an axis parallel with the first machine direction, i.e. parallel with the direction of movement DM of the fourth conveyor loops 30, the nip between the rollers 110 being in the aforementioned gap G3. The elongated blade 100 is configured to move into the gap G3 to a position above the nip, thereby forcing the entire underlying extension in the machine direction of the linen sheet L lying on the upper run 31 of the temporarily halted fourth conveyor loop 30 shown in FIG. 5*b* into the gap G3 and into engagement with the rotating rollers 110. This leads to a further folding of the linen sheet L, with a gradually increasing front part of the now further folded linen sheet L hanging suspended below the gap G3. The blade 100 may be replaced by, or combined with, air outlets serving the same function.

An air blast from the sideways oriented air nozzles 115 located below the rollers 110, or any other guide, serves to direct the suspended leading edge of this front part in a sideways direction oriented towards one of the opposite side walls W of the housing H. Rotation of the rollers 110 advance this leading edge towards and onto the upper run 36 of a fifth conveyor loop/second machine direction conveyor loop 35, located below the fourth conveyor loop 30 upper run 31, which fifth conveyor loop 35 is configured to carry and convey the cross-wise folded linen sheet L further in the second machine direction of the folder 1, in the shown embodiment to the left indicated by letters DM, to a succession of further folding stations S4, S5. Use of rollers 110 with integrated drum motors has proven space saving, since no separate roller 110 belt or similar drives need be placed adjacent the front or rear ends 5, 6 of the folder 1. The fifth conveyor loop 35 may be divided into sections along its length, to allow for a controlling such that a cross-wise folded linen sheet L leaving one primary cross-folding station S3 is not discharged on top of another cross-wise folded linen sheet discharged from another primary cross-folding station S3, such as by allowing for a short, temporary buffering by halting movement of such sections of the fifth conveyor loop 35. Alternatively, a delay in the movement of the respective blade 100 of the primary cross-folding stations S3 may be provided for, for the aforementioned purpose.

Stopping the movement of the respective fourth conveyor loop 30 may be when a sensor at the primary cross-wise folding station S3 detects full presence within the primary cross-wise folding station S3 on the upper run 31 of a linen sheet L to be cross-wise folded, or may take place based on the original lane-by-lane detections by sensors 7 and information of the speed of advancement of the respective linen sheets L by the first, second and third conveyor loops 10, 15, 20.

Shown also in FIG. 5*b* is the aforementioned fifth conveyor loop 35 extending from one wall towards the opposite wall W, towards a succession of further cross-wise folding stations S4, S5 arranged next to the housing H in which the aforementioned folding stations S1, S2, S3 are accommodated. The fifth conveyor loop 35 preferably receives linen sheets L from all the cross-wise folding stations S3. In FIG. 5*b* directions in which linen sheets L are moved are indicated by arrows DM.

Figure 6A:
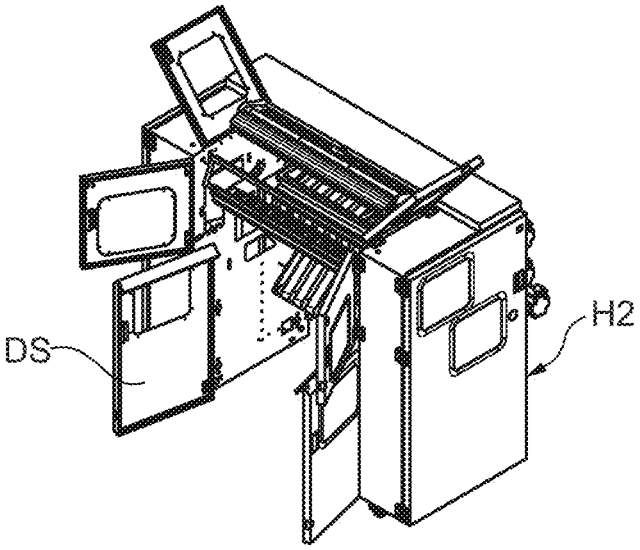
FIG. 6*a* shows a perspective view of a housing including further cross-wise folding stations.

FIG. 6*a* is a perspective view showing a housing part H2 and accommodating the succession of further cross-wise folding stations S4, S5 where a further cross-wise folding of the linen sheets L is performed. While the fifth conveyor loop 35 may form part of a further cross-wise folding station S4 it is preferred that all linen sheets L advanced then in the second machine direction are transferred onto the upper run 41 of a sixth conveyor loop 40, to allow for the housing part H2 to be removed from the remaining part of the folder 1. In the shown embodiment the further folding stations S4, S5 are arranged to the left of the folding stations S1, S2, S3 when the folder 1 is viewed towards the front side 6, and items of the further folding stations S4, S5 positioned furthest to the left will in the following be referred to as being at the left while items of the further folding stations S4, S5 positioned to the right will be referred to as being to the right. The opposite will apply where the further folding stations S4, S5 are arranged to the right of the folding stations S1, S2, S3 when the folder 1 is viewed towards the front side 6. An essentially identical such housing part H2 may be at each side wall W, each housing part H2 receiving linen sheets L from selected ones of the primary cross-folding stations S3, for further cross-folding.

Figure 6B:
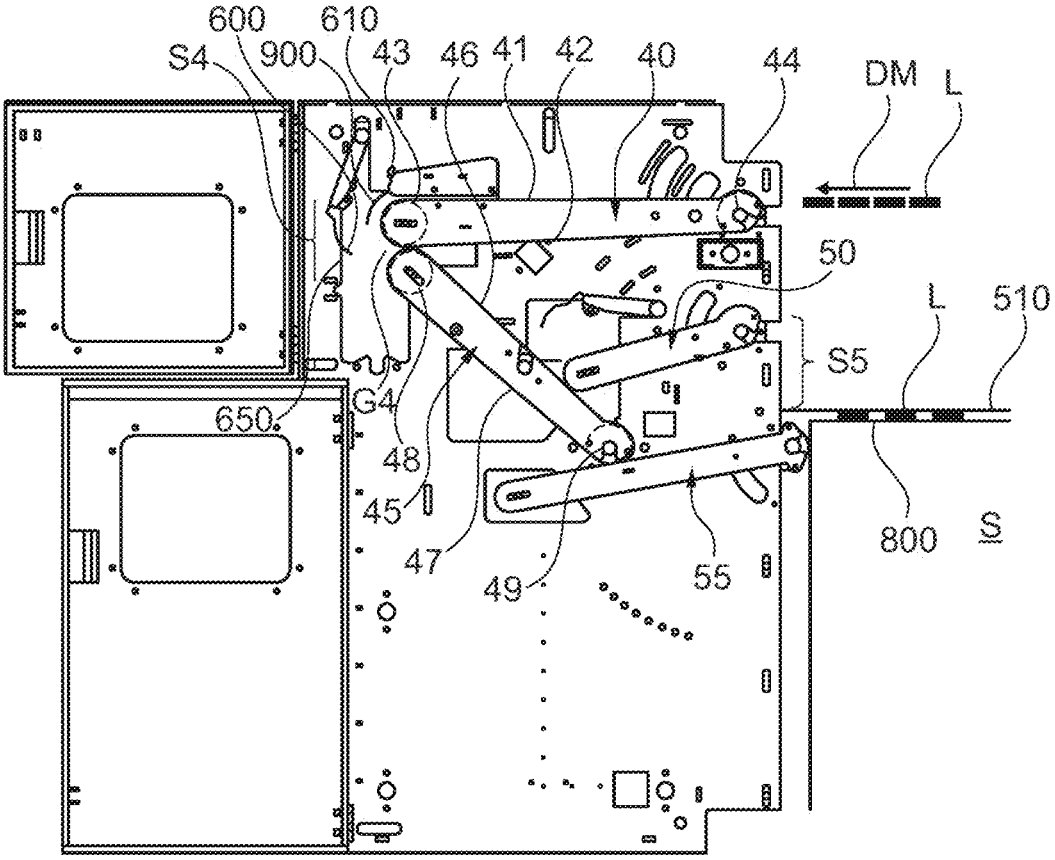
FIGS. 6*b* and 6*c* are cross-sectional and perspective views of the further folding stations in the housing shown in FIG. 6*a*, in two configurations.

The housing part H2 comprises a number of secondary conveyor loops 40, 45, 50, 55, each including an upper and a lower run and guided and driven by a number of respective left and right rollers. In FIG. 6*b* the upper run 41 of the sixth conveyor loop 40 is configured to carry the linen sheets L (not shown) in the second machine direction towards a sixth conveyor loop 40 left roller 43. A lower run 42 of the sixth conveyor loop 40 extends back to sixth conveyor loop 40 right roller 44. A seventh conveyor loop 45 extends at an angle downwards from left roller 48 to a seventh conveyor loop 45 right roller 49, with upper and lower runs thereof designated numerals 46, 47, respectively. The two left rollers 43, 48 rotate in opposite directions, the upper roller 43 rotating anticlockwise while the lower roller 48 rotates clock-wise, to advance the linen sheets L at a uniform speed.

The two left rollers 43, 48 are arranged close to each other, to define in a manner similar to folding station S1 a narrow gap G4 between the lower run 42 of the sixth conveyor loop 40 and the upper run 46 of the seventh conveyor loop 45. A pivotable or otherwise movable blade 600 and a blade actuator 610 are located to the left of the left rollers 43, 48.

When a previously cross-wise folded linen sheet L is advanced by the upper run 41 its leading edge will eventually leave the upper run 41 at the sixth conveyor loop 40 left roller 43, with a gradually increasing front part of the linen sheet L hanging suspended in front of gap G4. For making a fold the blade 600 is turned once, from a retracted position to an advanced position where a nose portion 650 thereof extends into the gap G4. This will be the case where the third guide member 900 is in a retracted position (not shown), in principle in the manner discussed above with reference to FIGS. 4*b* and 4*c*. Further cross-folding may take place at the left end of the shown conveyor loop 50, in a manner known in the art as "reverser folding".

Where the third guide member 900 has alternatively been moved to an advanced position the linen sheet L leading edge is simply directed onwards into the gap G4 between the left rollers 43, 48, with no folding taking place.

Figure 6C:
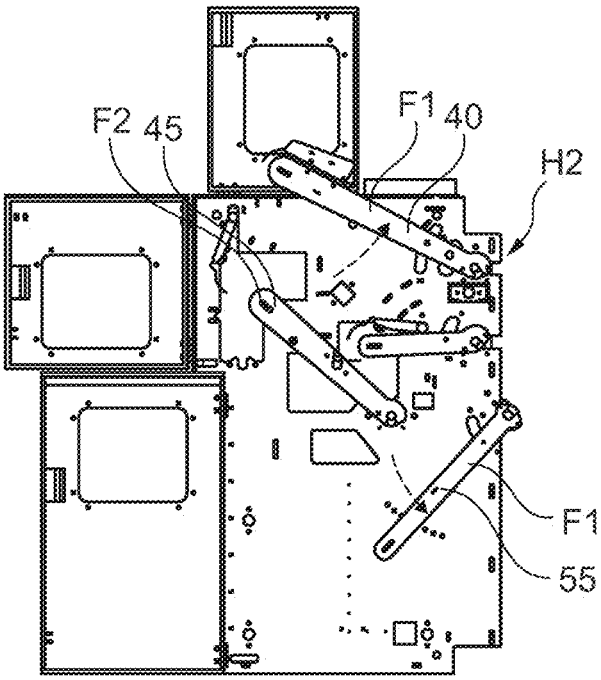
Figure 7A:
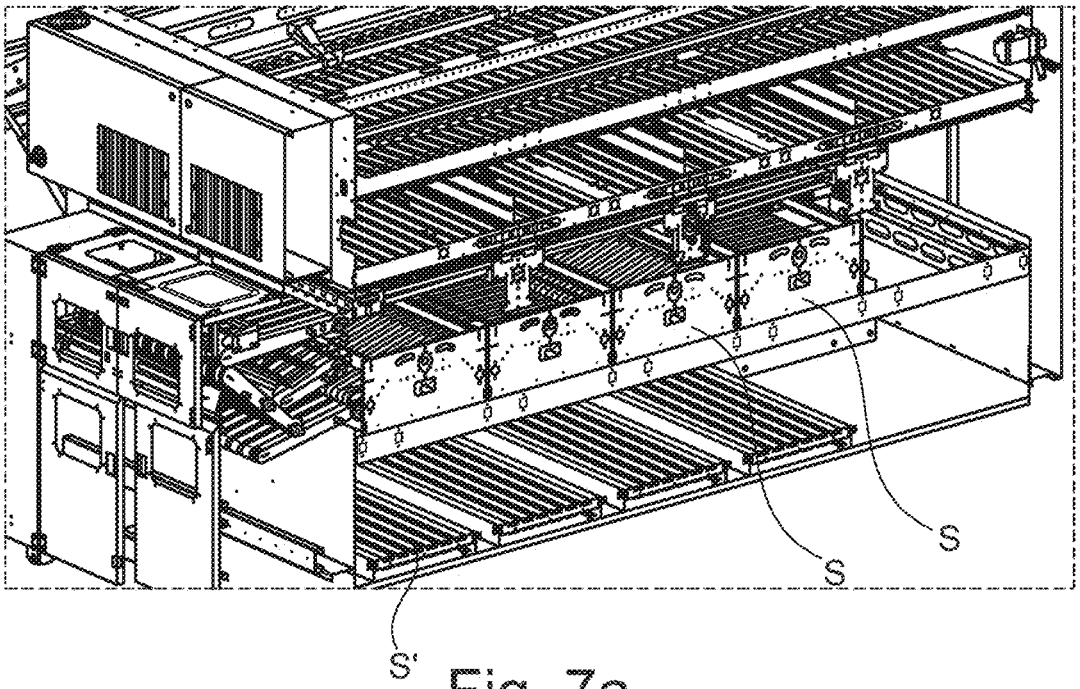
FIGS. 7*a*, 7*b* and 7*c* show details of stacker units incorporated in the folder of FIG. 2*a*, through front perspective views and a front view.
Figure 7B:
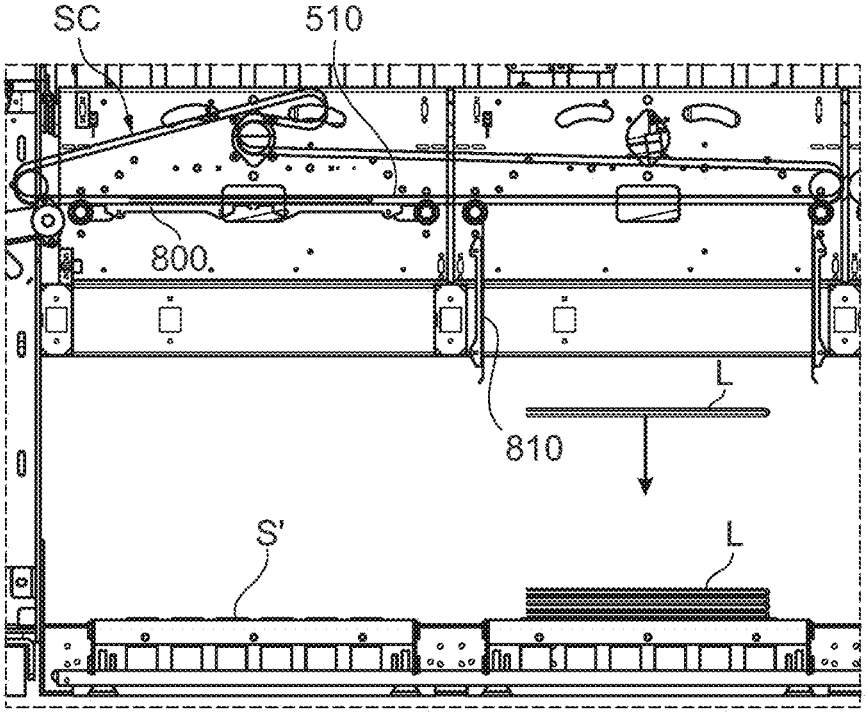
Figure 7C:
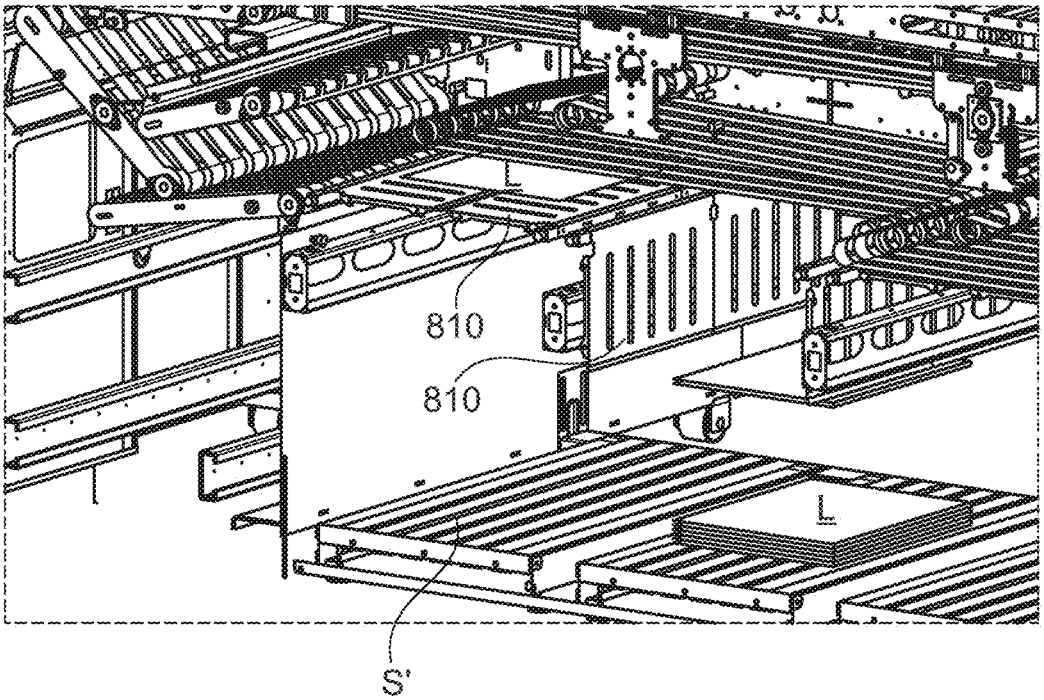

FIG. 6*c* shows an highly advantageous embodiment that may be generally applied, where one or more individual frames F1 that carry respective ones of the secondary conveyor loops 40, 55 are pivotally or otherwise movably supported within the housing part H2; this allows an operator easy access for removing folded linen sheets L that for some reason have become stock inside the housing part H2.

Specifically, one or more releasable locks, such as latches, may be provided for temporarily maintaining the movable frames F1 in positions with pairs (40, 45), (45, 55) of the secondary conveyor loops 40, 45, 50, 55 distant each other as shown in FIG. 6*c* and in an operative position where they are close to each other to provide for the cross-wise folding as shown in FIG. *b*.

Shown also schematically in FIG. 6*b* is the lower run 510 of a stacker conveyor SC, which stacker conveyor SC is arranged and configured to sandwich a folded linen sheet L received from the secondary conveyor loop 55 between the lower run 510 and the smooth upper surface 800 of a first stacker module S of the plurality of stacker modules S. The stacker conveyor SC operates to convey the sandwiched folded linen sheet L opposite the second machine direction towards a predetermined stacker module S to which the folded linen sheet is to be delivered. In this process the folded linen sheet L slides upon the aforementioned upper surface 800 of each stacker module S; when reaching the predetermined stacker module S, a gate 810 defining in part the smooth upper surface 810 is opened automatically by the folder 1 controller also communicating with the sensors 7, allowing the linen sheet L to drop either directly onto the associated discharge conveyor S' onto which the folded linen sheets L are stacked, as shown, or into a collection bin (not shown) defined by the stacker module S, for later discharge of a stack of folded linen sheets L onto the associated discharge conveyor S'.

Where two cross-fold housing parts H2 are used, one at each side wall W, each housing part H2 may deliver folded linen sheets L to a corresponding left or right series of stacker modules S. Stacker modules S may be added to the folder device 1 as required, FIG. 5*a* showing no stacker modules S.

The invention claimed is:

1. A folding device for forming folded linen sheets, comprising:

a housing having opposite side walls, a rear side and a front side;

a direction from the rear side to the front side defining a first machine direction of said folding device and a direction perpendicularly thereto, towards one of said side walls defining a second machine direction of said folding device;

a first conveyor defining a conveying surface for introducing linen sheets in said first machine direction, with two opposite edges of said linen sheets generally parallel to said first machine direction, wherein in operation of the folding device said linen sheets are cross-wise folded defining fold lines parallel with said first machine direction and length-wise folded defining fold lines perpendicularly thereto;

at least one length-wise folding station for forming length-wise folded linen sheets;

a second machine direction conveyor loop arranged in said housing below said length-wise folding station(s) and advancing said length-wise folded linen sheets in said second machine direction to a housing part, said housing part comprising a number of cross-wise folding stations for cross-wise folding said length-wise folded linen sheets and including a number of secondary conveyor loops, said secondary conveyor loops carrying and advancing said folded linen sheets in said second machine direction and opposite said second machine direction; and a stacker conveyor for advancing said cross-wise folded linen sheets from said secondary conveyor loops opposite said second machine direction to one or more folded linen sheet stacker modules positioned below said at least one length-wise folding station between said opposite side walls within said folding device housing at said front side, said one or more stacker modules comprising a collection bin, said bin being arranged and configured to discharge, upon request, a stack of said folded linen sheets stored within the collection bin, by dropping the stack directly onto a respective, associated discharge conveyor.

2. A folding device for forming folded linen sheets, comprising:

a housing having opposite side walls, a rear side and a front side;

a direction from the rear side to the front side defining a first machine direction of said folding device and a direction perpendicularly thereto, towards one of said side walls defining a second machine direction of said folding device;

a first conveyor defining a conveying surface for introducing linen sheets in said first machine direction, with two opposite edges of said linen sheets generally parallel to said first machine direction, wherein in operation of the folding device said linen sheets are cross-wise folded defining fold lines parallel with said first machine direction and length-wise folded defining fold lines perpendicularly thereto:

at least one length-wise folding station forming length-wise folded linen sheets;

a second machine direction conveyor loop arranged in said housing below said length-wise folding station(s) and advancing said length-wise folded linen sheets in said second machine direction to a housing part, said housing part comprising a number of cross-wise folding stations for cross-wise folding said length-wise folded linen sheets and including a number of secondary conveyor loops, said secondary conveyor loops carrying and advancing said folded linen sheets in said second machine direction and opposite said second machine direction;

wherein at least one primary cross-wise folding station in said housing receiving said linen sheets from said length-wise folding station(s);

a fourth conveyor loop including an upper run and a lower run of neighbouring belts, said neighbouring belts defining between them a primary cross-wise folding gap;

a pair of opposite rollers oriented to rotate about an axis generally parallel with said first machine direction, a nip between said opposite rollers being at said primary cross-wise folding gap;

a cross-wise folding blade arranged to be moveable up and down into said primary cross-wise folding gap to said nip and/or an air outlet being arranged above said nip, for forcing a portion of a length-wise folded linen sheet into said cross-wise folding gap;

said second machine direction conveyer loop advancing said linen sheets in said second machine direction from said primary cross-wise folding section to said housing part; and a stacker conveyor for advancing said cross-wise folded linen sheets from said secondary conveyor loops opposite said second machine direction to one or more folded linen sheet stacker modules positioned below said at least one length-wise folding station between said opposite side walls within said folding device housing at said front side, said one or more stacker modules comprising a collection bin, said bin being arranged and configured to discharge, upon request, a stack of said folded linen sheets stored within the collection bin, by dropping the stack directly onto a respective, associated discharge conveyor.

3. The folding device of claim 1, further comprising:

a succession of primary conveyor loops, each primary conveyor loop including an upper run and a lower run, a respective front roller closer to said front side and a respective rear roller closer to said rear side, said primary conveyor loops advancing said linen sheets in said first machine direction and opposite said first machine direction;

the front roller of a first conveyor loop and of a next, second conveyor loop of said succession arranged to define a first gap between the lower run of said first conveyor loop and the upper run of said second conveyor loop;

the rear roller of said second conveyor loop and of a next, third conveyor loop of said succession arranged to define a second gap between the lower run of said second conveyor loop and the upper run of said third conveyor loop, and at least one of said length-wise folding stations at one or more of said first and second gap(s), for forming length-wise folded linen sheets.

4. The folding device according to claim 3, said length-wise folding stations including at least one of a movable blade and an air blast nozzle, for forcing a portion of a linen sheet into a corresponding one of said gaps.

5. The folding device according to claim 3, wherein the lower run of said second conveyor loop and the upper run of said third conveyor loop converging for said gap to gradually narrow down.

6. The folding device according to claim 1, further comprising:

a first secondary conveyor loop in said housing part having an upper run and a lower run, and extending around a first roller and a second roller;

a second secondary conveyor loop in said housing part having an upper run and a lower run, and extending around a third roller and a fourth roller;

said first and third rollers arranged to define a cross-wise folding gap between said lower run of said first secondary conveyor loop and said upper run of said second secondary conveyor loop;

a movable folding blade and/or an air outlet defining together with said cross-wise folding gap one of said cross-wise folding stations for cross-wise folding of said length-wise folded linen sheets.

7. The folding device according to claim 1, wherein at least one primary cross-wise folding station in said housing receiving said linen sheets from said length-wise folding station(s) and comprising:

a fourth conveyor loop including an upper run and a lower run of neighbouring belts, said neighbouring belts defining between them a primary cross-wise folding gap;

a pair of opposite rollers oriented to rotate about an axis generally parallel with said first machine direction, a nip between said opposite rollers being at said primary cross-wise folding gap;

a cross-wise folding blade arranged to be movable up and down into said primary cross-wise folding gap to said nip and/or an air outlet being arranged above said nip, for forcing a portion of a length-wise folded linen sheet into said cross-wise folding gap;

said second machine direction conveyor loop advancing said linen sheets in said second machine direction from said primary cross-wise folding section to said housing part.

8. The folding device according to claim 7, said pair of opposite rollers being located inside said fourth conveyor loop and rotating in opposite directions about a respective axis parallel with said first machine direction, said rollers of said pair of opposed rollers optionally being driven by drum motors integrated therein.

9. The folding device according to claim 7, including cross-wise folded linen sheet guides, such as air nozzles, being arranged below said primary cross-wise folding gap for directing said cross-wise folded linen sheet onto said second machine direction conveyor loop.

10. The folding device according to claim 7, comprising:

a plurality of individually controllable length-wise folding stations positioned next to each other in the direction between said opposite side walls, such as for individual length-wise folding of respective linen sheets introduced into said folding device alongside each other between said side walls, a plurality of said primary cross-wise folding stations positioned next to each other in the direction between said walls;

a respective primary cross-wise folding station assigned to one or more of said plurality of length-wise folding stations, for receiving length-wise folded linen sheets therefrom.

11. The folding device according to claim 10, wherein controlling for each folding stations comprises activating said blade to move and/or said air blast nozzles to give off an air blast.

12. The folding device according to claim 7, said second machine direction conveyor loop being arranged below said upper run of said fourth conveyor loop(s) and receiving folded linen sheets from all of, or some of, said plurality of primary cross-wise folding stations.

13. The folding device according to claim 1, including a plurality of said folded linen sheet stacker modules positioned next to each other between said walls within said folding device housing at said front side, said plurality of stacker modules receiving respective cross-wise folded linen sheets advanced opposite said second machine direction from said secondary conveyor loops.

14. The folding device according to claim 1, said one or more stacker modules comprising a gate arranged and configured to discharge folded linen sheets directly onto the respective, associated discharge conveyor on which a stack of said folded linen sheets can be formed.

15. The folding device according to claim 1 or 2, wherein said discharge conveyor extends out from the housing at said front side.

16. The folding device according to claim 1 or 2, said first conveyor extending to a top portion of said folding device.

17. The folding device according to claim 1, said second secondary conveyor loop extending at an angle downwards from a third roller to a fourth roller.

18. The folding device according to claim 1 or 2, further comprising: a first conveyor frame being connected to said housing at a top portion of said housing and configured for angular adjustment of said first conveyor with respect to a vertical direction, to allow said first conveyor to reach a level of the output of an ironer positioned upstream of said folding device.

19. The folding device according to claim 1 or 2, a distance between said opposite walls being selected to allow for two or three or even more linen sheets to be processed simultaneously, by being introduced lying alongside each other on said conveying surface of said first conveyor, to define a multi-lane folding device, said distance preferably being at least 3 meters.

20. The folding device according to claim 1 or 2, said housing having a height at said rear side, said height being at least 1.6 meters, preferably at least 1.7 meters, preferably at least 1.8 meters.

21. The folding de d ng to claim 1 or 2, wherein said first conveyor defining a convening surface for introducing linen sheets in said first machine direction with two opposite edges of said linen sheets generally parallel to said first machine direction.

* * * * *